US006570537B2

(12) United States Patent
Frey, Jr.

(10) Patent No.: US 6,570,537 B2
(45) Date of Patent: May 27, 2003

(54) HYPER-SCANNING DIGITAL BEAM FORMER

(75) Inventor: Thomas L. Frey, Jr., Ft. Worth, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/894,632

(22) Filed: Jun. 28, 2001

(65) Prior Publication Data

US 2003/0006932 A1 Jan. 9, 2003

(51) Int. Cl.[7] ..... H01Q 3/22; H01Q 3/24; H01Q 3/26

(52) U.S. Cl. ..... 342/373

(58) Field of Search ..... 342/373

(56) References Cited

U.S. PATENT DOCUMENTS 5,077,562 A * 12/1991 Chang et al. ..... 342/368
5,856,804 A 1/1999 Turcotte et al.

FOREIGN PATENT DOCUMENTS

EP 0 654 915 A 5/1995

OTHER PUBLICATIONS

Kuipers, Martin et al., "*A Digital Chip Design For Smart Antennas*", (VTC 1999–Fall, IEEE VTS 50$^{th}$, Vehicular Technology Conference, Gateway to the 21$^{st}$ Century Communications Village. Amsterdamn, Sep. 19–22, 1999,) *IEEE Vehicular Technology Conference, IEEE, US, vol. 3, Conf 50*, Sep. 19, 1999, pp. 1870–1874, New York, NY.

* cited by examiner

*Primary Examiner*—Theodore M. Blum
(74) *Attorney, Agent, or Firm*—Jakcson Walker, LLP

(57) ABSTRACT

The present invention provides a hyper-scanning digital beam former, which includes a plurality of digitizing units (N) having respective inputs for receiving a respective signal from a plurality of elements of an antenna. The digitizing units are operably configured to digitally convert the element antenna signals at a first clock rate; a summing circuit having an input for receiving the digital signals from respective outputs of the digitizing units and operably configured to generate a plurality of output signals (M) by summing ones of the digital signals; and a channel processor having an input for receiving the M output signals and operably configured to process the M output signals at a second clock rate in which the second clock rate is at least M times faster than the first clock rate.

18 Claims, 2 Drawing Sheets

HYPER-SCANNING DIGITAL BEAM FORMER

This invention was made with Government support under Contract Number F33657-91-C-0006 awarded by The Department of the Air Force. The Government has certain rights in this invention.

BACKGROUND OF THE INVENTION

TECHNICAL FIELD OF THE INVENTION

The present invention relates generally to the field radiated wave communications and, more particularly, to a beam forming antenna processing system.

DESCRIPTION OF THE RELATED ART

A dish antenna directs a radar beam in a single fixed direction, and the antenna is mechanically repositioned to change the beam direction. The dish antenna is rotated to produce a 360 degree scanning beam. An electronic radar antenna produces directional beam control through phase control of individual antenna radiating elements, without requiring mechanically driven movement of the antenna.

Digital beam forming is a powerful technique for augmenting antenna performance. Typically, a digital beam former operates in conjunction with a phased-array antenna to enhance the overall quality of radiated data signals. Generally, the individual radiating elements are combined mathematically so that the collective radiation from the elements forms a beam which maximizes gain in the desired field of observation in accordance with electronic steering control.

In a receiver, a radiated wave front impinging on an array antenna causes signals received at various antenna elements to differ in phase due to the angle of the wave front relative to the array. The digital beam former compensates for this phase shift and sums together the different element signals such that an improved signal-to-noise ratio is obtained at its output. Electronic beam-steering antenna arrays can be used in various kinds of radar and communication systems. Thus, these arrays can be used in target acquisition systems, communication systems, pulsed radar systems, continuous wave radar systems, etc.

Many systems depend on apertures with relatively wide fields of view. In some cases the apertures are essentially omni-directional. As the field of view expands, this increases the susceptibility of the system to interference, multi-path reflections, and overlapping replies from non-synchronous, spatially diverse sources, introducing additional design constraints.

A common solution to these design challenges is to employ beam forming techniques such as fixed or electronically scanned phased arrays. The narrower beam allows the sensitivity to be focused in the direction of the desired signal while reducing sensitivity towards signals and interference from angles outside of the main-beam. Sensitivity for signals within the main-beam of the array is increased as the true or synthetic aperture gain is increased. For static circumstances such as point to point data links, this is an effective solution under most situations. For synchronous participants alternating time slots, the beam can be scanned or pointed towards each participant on a slot by slot basis.

As the participants become asynchronous, the data streams can overlap in time. Often it is necessary to be sensitive across a wider spatial field of view instantaneously.

This in turn reduces the overall resistance to interference and the overall sensitivity in the direction of the signal or signals of interest. It also introduces a new problem; detection and separating signals that are coincident in time but spatially separated.

One way to address these problems is with digital beam-forming. Digital beam-forming allows beams to be defined and formed mathematically after the waveform has already been sampled by each individual element of an array. However, the throughput required to form and process many beams in each sample can be very large, often exceeding the capability of legacy systems. It also requires large amounts of information to be stored (memory) and processed though the detection algorithm, a large majority of which is not of interest.

SUMMARY OF THE INVENTION

The present invention achieves technical advantages as a method, system and apparatus for hyper-scanning digital beam forming, which includes a plurality of digitizing units (N) having respective inputs for receiving a respective signal from a plurality of elements of an antenna. The digitizing units are operably configured to digitally convert the element antenna signals at a first clock rate; a summing circuit having an input for receiving the digital signals from respective outputs of the digitizing units and operably configured to generate a plurality of output signals (M) by summing ones of the digital signals; and a channel processor having an input for receiving the M output signals and operably configured to process the M output signals at a second clock rate in which the second clock rate is at least M times aster than the first clock rate. Further, the beam former "pipeline processor" architecture enables retrofit for legacy systems.

BRIEF DESCRIPTION OF THE DRAWINGS

For a more complete understanding of the present invention, reference is made to the following detailed description taken in conjunction with the accompanying drawings wherein.

DETAILED DESCRIPTION OF THE INVENTION

Figure 1:
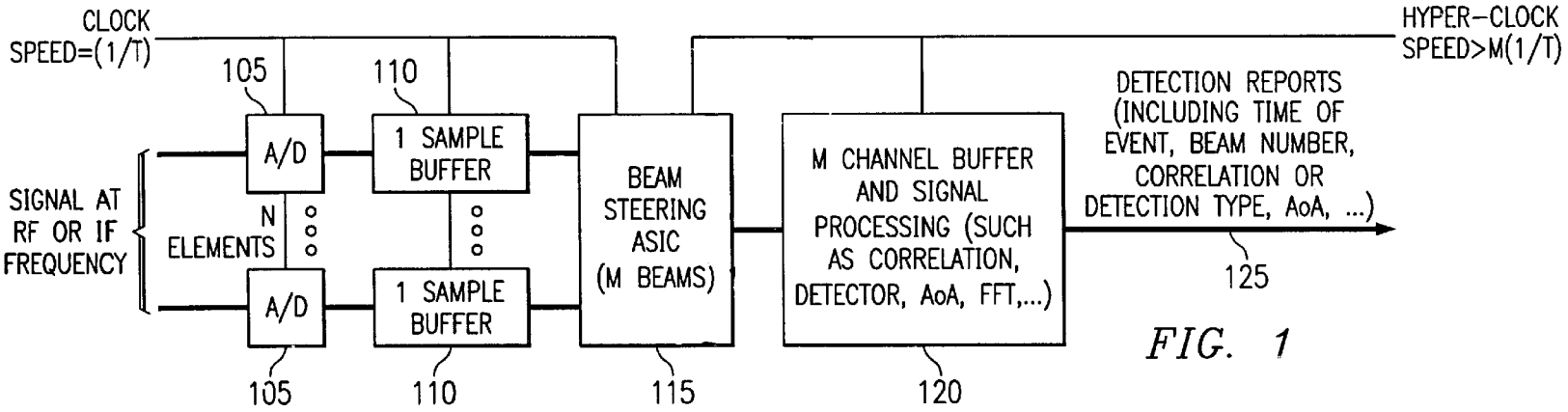
FIG. 1 illustrates a Hyper-Scanning digital beam forming network reusing a single processing path in accordance with an exemplary embodiment of the present invention.

The numerous innovative teachings of the present application will be described with particular reference to the presently preferred exemplary embodiments. However, it should be understood that this class of embodiments provides only a few examples of the many advantageous uses and innovative teachings herein. In general, statements made in the specification of the present application do not necessarily delimit any of the various claimed inventions.

Moreover, some statements may apply to some inventive features, but not to others.

In many radar and communication applications, it is desirable to have to use a formed beam(s) to increase gain and to protect against interference. However, if the precise location of the emitter is not known, it is advantageous to maximize the instantaneous field of view of the receiver to reduce the acquisition time. A novel solution is to sample each antenna element as an individual data stream and digitally construct a set of beams and discriminators in parallel (or nearly parallel) that can instantaneously scan a formed beam through the complete field of regard for each sample. This technique would allow for each signal or interference to be evaluated at peak sensitivity while attenuating other signals outside of the beam. It also allows for temporally coincident, but spatially separated signals to be detected and evaluated while still providing resistance to unwanted interference. Though this approach would improve the sensitivity and selectivity, it would greatly increases the number of necessary operations and currently is not feasible or at least not economically feasible. However, at least one embodiment of the present invention offers an advantageous solution that can produce about the same computation power through inventive preprocessing.

In accordance with the present invention, hyper-scanning refers to a method to scan rapidly through a number of beams (M), essentially instantaneously, from the reference point of the data stream. Hyper-scanning can be accomplished either by introducing M parallel processing paths or by using a single processing path that can operate on a data stream M times for each sample in the data stream. The later approach offers some attractive features such as reduced hardware and the ability to add this capability to an existing system.

Consider a detection circuit that has been implemented in a pipeline processor as a series of ASICs. In this pipeline processor an input signal, either at RF or IF, is filtered, limited, sampled, and processed to determine if the signal of interest is present and, if so, what is its state (e.g., mode, data content, angle of arrival). Often the goal of the pipeline processor is to screen the input stream for specific signal attributes to greatly reduce the input rate into a later stage or processor. (An example of this might be a Kalman filter which may be throughput limited based on complexity or processor limitations.) This type of implementation can operate effectively in the presence of large pulse densities, for example.

Referring now to FIG. 1 there is illustrated an exemplary hyper-scanning digital beam forming network using a single processing path in accordance with the present invention. An array-antenna, for example, can include a number of elements (N) arranged in a linear array. The hyper-scanning network preferably includes a one-to-one correspondence between the N elements and, the analog-to-digital (A/D) converters 105 and buffers 110. It is understood that the present invention is not limited to linear arrays but can be applied to distributed aperture that are non-linear or even non-planar. As shown, each buffer 110 is coupled to an input of a beam-steering circuit 115. The beam steering circuit 115 is an application specific integrated circuit (ASIC) in at least one exemplary embodiment of the present invention. The network can also include a corresponding set of down converters for frequency down-converting, filtering, and amplification to a power lever commensurate with the A/D converters 105.

The beam steering ASIC 115 utilizes a pipeline processor architecture to read in the time coincident samples from each of the N-elements in the single sample buffers 110 and to form M-beams to cover the desired field of view before the next sample set is read. In order to accomplish this, the ASIC 115 makes use of two clocks: (1) the slower system clock operating at a rate notated as 1/T (where T is the sampling interval) and (2) a faster "hyper-clock" operating at a minimum rate of M times the slower system clock notated as M 1/T.

The slower system clock is used to read each new sample into the ASIC 115. The faster hyper-clock is then used to make M unique measurements on the new sample of data and output the results either to an M-channel buffer as in FIG. 1 or an M-position switch as shown and later described in FIG. 2. For each trigger from the hyper-clock, a new set of complex weighting functions is loaded into each path to mathematically form a beam. The resultant calculations such as the formation of Σ and Δ patterns can then be performed.

Consider an example for a hyper-clock working at four times the system clock and forming 4 distinct beams. The system clock triggers a new set of data being read into the ASIC 115. The first trigger from the hyper-clock results in the beam steering coefficients from beam 1 being loaded in and detection data being calculated as a result of beam 1 such as Σ and Δ patterns being calculated. The second trigger from the hyper clock results in the beam steer coefficients from beam 2 being loaded and its respective detection data being calculated. This continues for the third and fourth trigger of the hyper-clock. With the next system clock trigger, this process begins again with the next set of data from the front end. Therefore every data sample from the front end at the system (slower) clock results in M output measurements, one for each digital beam.

The beam steering ASIC 115 also has an output for outputting the results of each beam in separate channels in a M channel buffer/signal processing section 120 (M-CBSPS). After the signal is sampled, it is filtered to discriminate (or measure) pulse width, estimate the angle of arrival AoA, and detect the event of interest (such as a preamble sequence.) Since the AoA is determined for each sample, once the event of interest has been detected, the corresponding AoA can be selected for that signal of interest. The M-CBSPS 120 then performs the normal processing task, such as correlation, detector, AoA, FFT, etc. on each of the M separate data streams using a single set of processing assets or pipeline processor as a series of ASICs that can operate on the data steams M times for each sample in the data stream.

Subsequently, detecting reports can be issued from an output 125 which can include the time of event, beam number, correlation or detection type, AoA, etc. Hyper-scanning is achieved by configuring the beam steering ASIC 115 and M-CBSPS 120 with processing components which operate at a much higher clock rate than the pre-beam steering processing components (i.e., A/D converters, sample buffers, etc.) clock rate (1/T). The hyper-scanning clock rate is:

$$(1/T)_{hyperscanning} \geq M \cdot (1/T) \qquad \text{Equation 1}$$

enabling M synthetic beams for each sample of the waveform. Because the electronic scanning phase adjustments can be calculated a priori, the complete digital beam forming calculation can be implemented on an ASIC chip. The phase adjustments are the weighting values that are added to each line to form the beam. Since the desired beams are define ahead of time and reused, time or throughput are not unnecessarily spent to recalculating the same values continuously. However, another embodiment uses an adaptive beam approach in which beam weightings are calculated dynamically.

Figure 2:
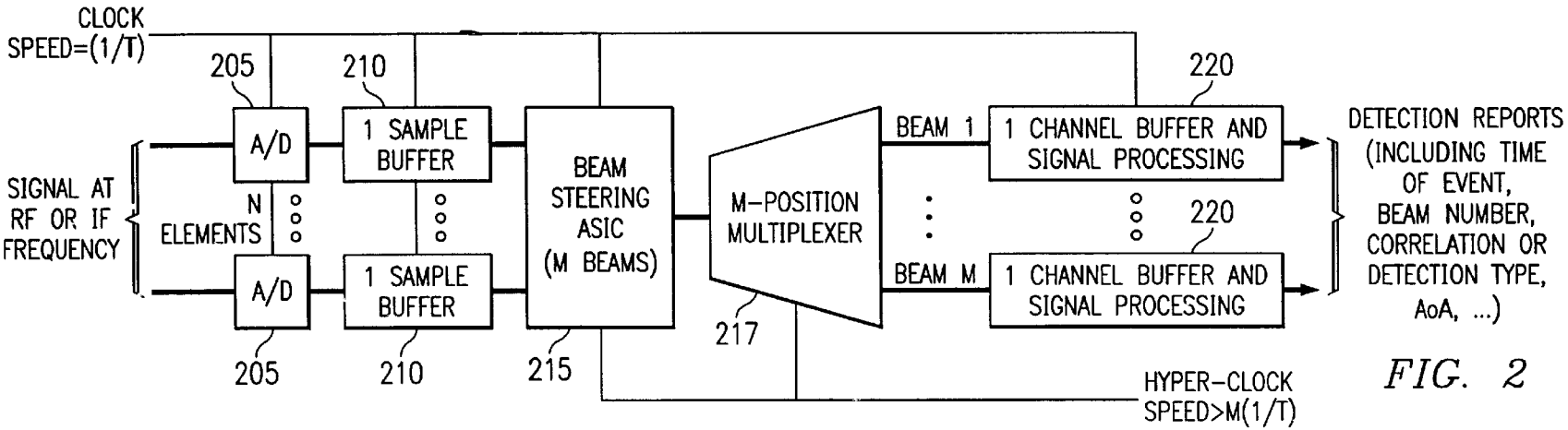
FIG. 2 illustrates a Hyper-Scanning digital beam forming network implemented using parallel processing in accordance with an exemplary embodiment of the present invention.

Referring now to FIG. 2, there is illustrated an exemplary Hyper-scanning digital beam forming network using M parallel processing paths for processing each of the M formed beams in accordance with the present invention. In a preferred embodiment, each of the M parallel processing paths are ASICs. The Hyper-scanning network receives signals from an array antenna, for example, which includes a number of elements (N). The received signals are digitized by the A/D circuits 205, for each N element, to produce digital signals. Each A/D circuit is dedicated to processing the signals produced by a respective array element. After the A/D conversion, the digital signals can be output to a respective sample buffer 210 prior to being introduced to a beam steering circuit 215. The A/D circuits 205 and sample buffers 210 operate at a predetermined clock speed 1/T. The beam-steering circuit 215 receives the samples from an output of the sample buffers 210 and determines a complex sum of the N antenna elements for M different preset beam positions. The beam steering circuit is preferably an application specific integrated circuit (ASIC). Note that the ASIC implementation can be the same, regardless of whether the parallel architecture of FIG. 2 or sequential architecture of FIG. 1 is chosen. Alternately, the ASIC can be customized to better support the existing circuitry or to include additional capability.

The beam steering ASIC 215 also has an output for outputting the results of each beam to a M-position multiplexer 217. The multiplexer selects the M beam data streams for transmission to one of the single channel parallel processing sections 220. Preferably there are M number of processing sections. Each single channel signal processing section then performs the standard processing task and, subsequently issues detection reports which can include the time of the event, beam number correlation or detection type, AoA etc. Hyper-scanning is achieved by configuring the beam steering ASIC 215 and multiplexer 217 with processing components which operate at a much higher clock rate (hyper-scanning clock rate) than the pre-beam steering processing components. Each of the parallel processing sections 220 operate at the same clock (1/T, where T is the sampling interval) as the pre-beam steering processing components. Thus, the hyper-scanning clock rate is:

$$(1/T)_{hyperscanning} \geqq M \cdot (1/T)$$

enabling rapid scanning through M beams essentially instantaneously from the reference point of the data stream.

The ability to simultaneously form multiple beams across a wide field of view offers improved performance against interference, increased gain, and the capability to recover and separate two time coincident signal that are spatially diverse. In a wide field of view system, given two equal magnitude signals arriving at the detection circuit at the same time, the result most likely is either a false detection at an angle halfway between the two angles or, perhaps worse, no detection.

Figure 4:
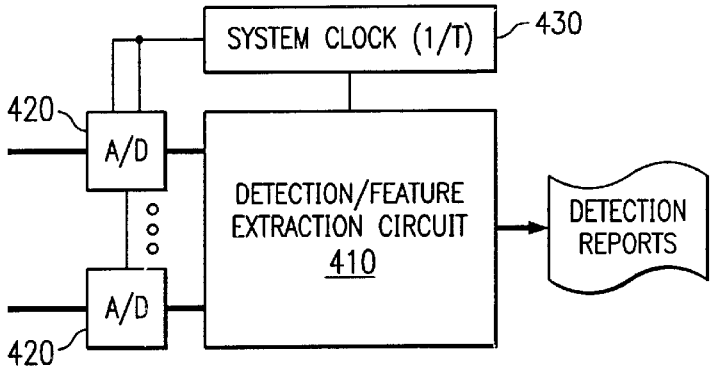
FIG. 4 illustrates an exemplary embodiment of retrofitting for parallel Hyper-Scanning digital beam forming system in accordance with an embodiment of the present invention.
Figure 5:
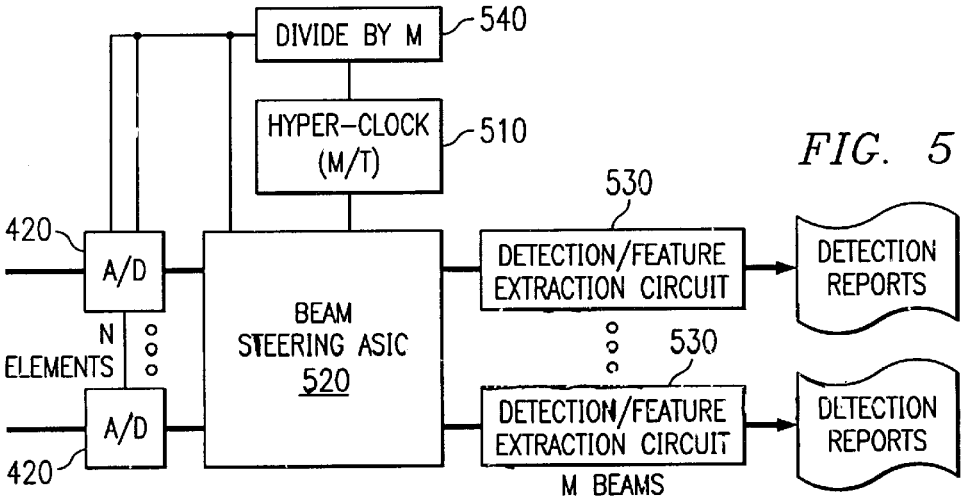
FIG. 5 illustrates a parallel implementation of a Hyper-Scanning architecture into the system illustrated in FIG. 4.

FIGS. 4 and 5 illustrate an exemplary embodiment of retrofitting for parallel Hyper-Scanning digital beam forming system in accordance with an embodiment of the present invention. More particularly, FIG. 4 illustrates an exemplary pre-processing portion of a simple detection system including a detection/feature circuit 410 and a number of analog-to-digital converters 420 fed by a system clock 430.

The analog signal is sampled by the analog to digital (A/D) converter 420 at the system clock rate (1/T). The sampled waveform is then routed to the detection/feature extraction preprocessor 410 to perform constant false alarm rate (CFAR) thresholding, pulse width measurements, preamble recognition, and angle of arrival (AoA) estimation for example. FIG. 5 gives an example of a parallel implementation of a hyper-scanning architecture into the system illustrated in FIG. 4. The existing clock 430 is replaced by the "hyper clock" (M/T) 510, a new beam steering ASIC 520 is added and additional detection/feature extraction preprocessors 530 are added. The "hyper-clock" provides a high frequency clock rate to the beam steering ASIC 520. Additionally, a sub-sampled clock 540 rate equal to the original clock rate (1/T) is supplied to the A/D converters 420, the beam steering ASIC 520, and each detection/feature extraction preprocessor 530.

Although embodiments of the present invention have been described in the foregoing Detailed Description for radio frequencies, it is understood that the invention is not limited to radio frequencies but can also be applied to other frequencies such as optical, infrared, electro-optical, acoustical, etc.

Figure 3:
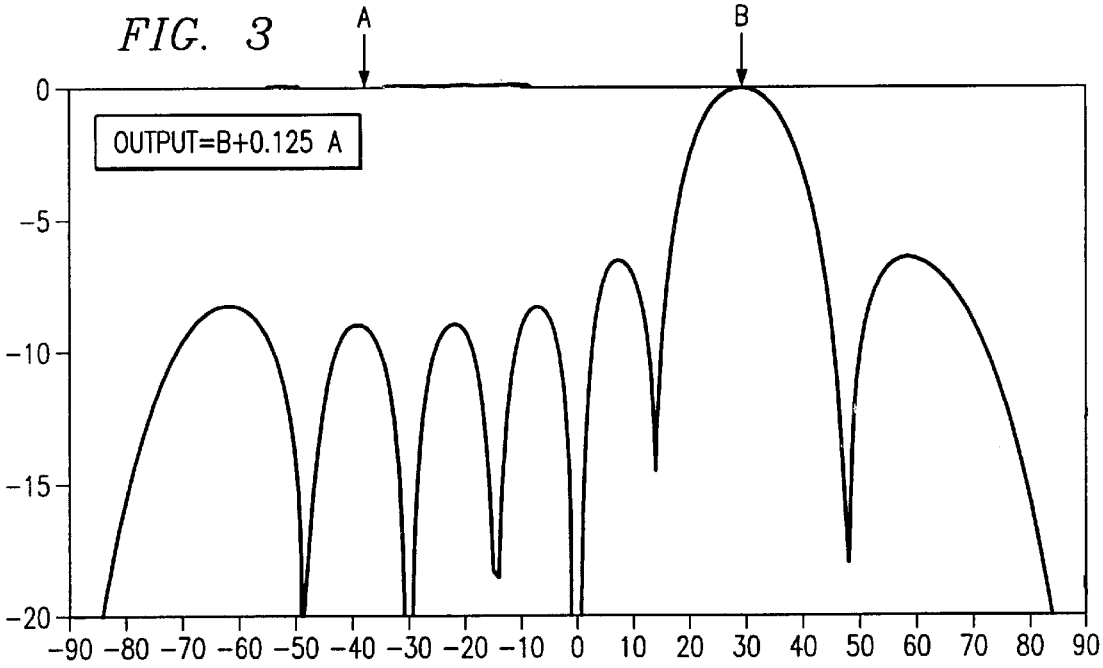
FIG. 3 illustrates a graphical representation of two equal signals with different AoA as received by a formed beam.

Referring now to FIG. 3 there is illustrated an exemplary plot of the normalized gain of an 8 element phased array with one-half wavelength spacing for detection of two equal magnitude signals. For the beam shown, B is 9 dB or eight times more powerful than A and under most condition could be recovered. At some other beam, A would be more powerful than B by a similar amount. Each detection from each beam can be reported independently to a later stage where the information can be combined if desired. The X-axis is the angle off antenna boresight from −90 degrees to +90 degrees. The Y-axis is the magnitude of the gain with the peak gain normalized to zero. The beam has been electronically scanned +30 degrees from the boresight. Signal A is arriving at −30 degrees and Signal B is arriving at +30 degrees. If the beam was not scanned, Signal A and B would arrive at the same amplitude and be difficult if not impossible to separate if they overlapped. By scanning the beam towards signal B, the gain of B is increased while the gain of A is decreased allowing B to be move easily recovered. A second beam is then similarly formed at −30 degrees on the same data to recover signal A. Note that using the same set of data, each signal can be recovered by mathematically altering the weighting coefficients and reprocessing. Therefore, time-coincident signals can be recovered by processing the same data multiple times with different beams.

The hyper-scanning architecture can be implemented as a pipeline processor using ASIC or FPGA technology and therefore it is very fast and removes almost all of the unwanted interference prior to the data processing stage. Because of the parallelism, this approach is easily scaleable to multiple dimensions (both spatial and spectral). Some advantages become more pronounced for spectrally diverse signals as the sampling point moves closer towards the antenna. As the "A/D" or sampling point moves to the antenna, processes that are performed currently in hardware, such as filtering and down conversion, will either be performed in software or not at all. In order to do this, sampling rates will have to increase to satisfy the Nyquist Criterion. With the higher data rates comes more data which translates into more processing and memory. It is clear that if the data can be "pruned" to only the desired samples, the throughput and memory for the rest of the system downstream can be drastically reduced. At least one embodiment of the present invention offers this "pruning". Further, once the data is digital and can be split or repeated without degradation, multiple ASICS can be run in parallel to operate on the same sample practically without limitation. This includes operating both in space and frequency.

When sampling a wave form at its transmitted frequency, the need to down-convert to an intermediate frequency is removed, the narrow-band filtering of the wide-band digital streams can be implemented within each specific processing thread, allowing different processes to operate on different portions of the spectrum in parallel using the same wide band digital stream.

Although a preferred embodiment of the apparatus, method and system of the present invention has been illustrated in the accompanied drawings and described in the foregoing Detailed Description, it is understood that the invention is not limited to the embodiments disclosed, but is capable of numerous rearrangements, modifications, and substitutions without departing from the spirit of the invention as set forth and defined by the following claims.

What is claimed is:

1. A digital beam former, comprising:

a front-end having a plurality of digitizing units for receiving a respective signal from a plurality of elements of an antenna and operably configured to digitally convert said plurality of signals at a first clock rate; and a beam forming device having an input for receiving said digital signals from respective outputs of said plurality of digitizing units and operably configured to generate M number of output signals by arithmetic operation of said digital signals at a second clock rate with a minimum speed proportional to said M number of output signals, wherein each of said output signals are representative of a digital beam.

2. The digital beam former of claim 1 further including a channel processor having an input for receiving said M digital beams and operably configured to process said M digital beams at said second clock rate, wherein said first clock rate is defined as 1/T in Which T is the sample interval of said digital signals and the second clock minimum rate is defined as M/T.

3. The digital beam former of claim 2, wherein said channel processor includes M number of processing devices coupled in parallel each for processing one of said digital beams at said first clock rate.

4. The digital beam former of claim 3, wherein digital beam processing includes one of determining correlation, event detection and angle of arrival.

5. The digital beam former of claim 2, wherein said channel processor processes each of said digital beams at said second clock rate.

6. The digital beam former of claim 5, wherein digital beam processing includes one of determining correlation, event detection and angle of arrival.

7. The digital beam former of claim 1, wherein said plurality of digitizing units comprise a plurality of analog-to-digital converters equal in number to said plurality of antenna elements.

8. The digital beam former of claim 1, wherein said first clock rate is defined as 1/T in which T is the sample interval of said digital signals and the second clock minimum rate is defined as M/T.

9. A beam forming system comprising:

a plurality of antenna elements for receiving a radiated signal and operable to convert said radiated signal to a representative electric signal;

a plurality of digitizing units each operable to receive said electric signal from a corresponding one of said element antennas to convert said received electric signal to a representative digital signal, said plurality of digitizing units operating at a first clock rate;

a forming circuit having an input for receiving said digital signals from respective outputs of said plurality of digitizing units and operable to generate a plurality of output signals (M) by synthesizing ones of said received digital signals at a second clock rate with a minimum speed proportional to said M number of output signals, wherein each of said output signals are representative of a digital beam.

10. The system of claim 9 further including a processor having an input for receiving said M digital beams and operably configured to process said M digital beams at said second clock rate, wherein said first clock rate is defined as 1/T in which T is the sample interval of said digital signals and the second clock minimum rate is defined as M/T.

11. The system of claim 10, wherein said processor includes M number of processing devices coupled in parallel each for processing one of said digital beams at said first clock rate.

12. The system of claim 11, wherein digital beam processing includes one of determining correlation, event detection and angle of arrival.

13. The system of claim 10 wherein said channel processor processes each of said digital beams at said second clock rate.

14. The system of claim 13, wherein digital beam processing includes one of determining correlation, event detection and angle of arrival.

15. The system of claim 9, wherein said plurality of digitizing units comprise a plurality of analog-to-digital converters equal to said plurality of antenna elements.

16. The system of claim 9, wherein said first clock rate is defined as 1/T in which T is the sample interval of said digital signals and the second clock minimum rate is defined as M/T.

17. A method of detecting temporally coincident signals from separate corresponding angles of arrivals using a multiple clock rate operating beam forming system, said method comprising:

receiving at least two analog signals from a plurality of element antennas, wherein each analog signal is indicative of a radiated signal from corresponding temporally coincident items of interest;

digitizing said received analog signals at a first clock rate;

generating output signals representing a plurality of virtual antenna beams (M) by synthesizing said digitizing analog signals at a second clock rate with a minimum speed proportional to said M number of output signals, wherein each of said output signals are representative of a virtual antenna beam; and processing said virtual antenna beams at said second clock rate.

18. The method of claim 17, wherein said first clock rate is defined as 1/T, and wherein T is defined as a sampling interval of said digitized signal and the second clock minimum rate is defined as M/T.

* * * * *